US006842597B2

(12) United States Patent
Yamaguchi et al.

(10) Patent No.: US 6,842,597 B2
(45) Date of Patent: Jan. 11, 2005

(54) IMAGE FORMATION APPARATUS INCLUDING AN OVERLAP BETWEEN PORTIONS OF A PHOTOSENSITIVE DRUM AND AN ADJACENT DEVELOPER UNIT

(75) Inventors: Naoki Yamaguchi, Kasuga (JP); Yuzo Kawano, Ogori (JP); Masakazu Aoki, Chikushi-gun (JP); Hirokazu Tasaka, Asakura-gun (JP); Yoshihiro Mizoguchi, Chikushi-gun (JP)

(73) Assignee: Matsushita Electric Industrial Company, Inc., Osaka (JP)

( * ) Notice: Subject to any disclaimer, the term of this patent is extended or adjusted under 35 U.S.C. 154(b) by 0 days.

(21) Appl. No.: 10/376,771

(22) Filed: Feb. 28, 2003

(65) Prior Publication Data

US 2003/0165346 A1 Sep. 4, 2003

(30) Foreign Application Priority Data

Mar. 1, 2002 (JP) ..... P. 2002-055632

(51) Int. Cl.[7] ..... G03G 15/01
(52) U.S. Cl. ..... 399/223
(58) Field of Search ..... 399/107, 113, 399/119, 222, 223, 231, 112, 116, 117

(56) References Cited

U.S. PATENT DOCUMENTS 6,477,349 B2 11/2002 Kanckura et al. ..... 399/302
6,577,832 B2 * 6/2003 Kanagawa et al. ..... 399/117

FOREIGN PATENT DOCUMENTS

| | | |
|---|---|---|
| JP | 2000-284592 | 10/2000 |
| JP | 2001-356545 | 12/2001 |
| JP | 2001-356549 | 12/2001 |

* cited by examiner

*Primary Examiner*—Hoan Tran
(74) *Attorney, Agent, or Firm*—Pearne & Gordon LLP

(57) ABSTRACT

A color image formation apparatus includes a plurality of stages of photosensitive drums provided for respective developing agents, the photosensitive drums arranged in a predetermined direction; and developer units which are provided for respective photosensitive drums and which develop electrostatic latent images formed on the photosensitive drums, wherein an overlap exists in the predetermined direction between a portion of each photosensitive drum and a portion of the developer unit provided so as to correspond to an adjacent photosensitive drum.

10 Claims, 9 Drawing Sheets

IMAGE FORMATION APPARATUS INCLUDING AN OVERLAP BETWEEN PORTIONS OF A PHOTOSENSITIVE DRUM AND AN ADJACENT DEVELOPER UNIT

BACKGROUND OF THE INVENTION

1. Field of the Invention

The invention relates to a color image formation apparatus which forms a synthetic image by superimposing image information by utilization of the electrophotography technique.

2. Description of the Related Art

In an image formation apparatus adopting the electrophotography technique, an electrophotographic photosensitive member serving as an image carrier is charged by a charger, and the photosensitive member is exposed to radiation in accordance with image information, to thereby form a latent image. A toner image into which the latent image is developed by a developer is transferred onto a sheet material or the like, to thereby produce an image.

In association with colorization of an image, a plurality of pieces of tandem image formation apparatus have hitherto been proposed. Such an apparatus is provided with a plurality of image carriers to be subjected to such a round of image formation processes. Color images; i.e., a cyan image, a magenta image, a yellow image, and preferably a black image, are formed on corresponding image carriers. Respective color images are transferred onto sheet material at respective transfer positions of the respective image carriers in a superimposed manner, thereby producing a full-color image. Such a tandem multiple-image formation apparatus is said to be advantageous in achieving speedup, because image formation sections are provided for respective colors.

As described in, e.g., Japanese Patent Publication No. 2000-284592, a tandem multiple-color image formation apparatus has an image formation unit for forming toner images of yellow (Y), magenta (M), cyan (C), and black (K) colors; an exposure device for forming an electrostatic latent image by outputting an image signal; an intermediate transfer belt which is made in the form of a closed loop and travels; and a fuser. A toner image formed on the intermediate transfer belt is transferred onto paper P supplied from a paper cassette, and the toner image is fixed on the paper by means of the fuser.

The yellow (Y) image formation unit, the magenta (M) image formation unit, the cyan (c) image formation unit, and the black (K) image formation unit share a common structure. One of the image formation units is shown in FIG. 9, which is a schematic front view of the principal section showing an example configuration of a related-art development unit and that of a related-art photosensitive unit. As illustrated, the image formation unit is a combination of a photosensitive unit and a development unit. The photosensitive unit has: a photosensitive drum 101, on a circumferential surface of which an electrostatic latent image is to be made by means of a laser beam emitted from an exposure device (not shown); a charger roller 102 for charging the latent image; and a cleaning blade 103. The development unit includes a toner feed tank 104, a toner feed roller 105, and a developer roller 106 to be brought into contact with the photosensitive drum 101, and a toner thin-layer blade 107 which comes into contact with the developer roller 106, to thereby make a toner layer a uniform thin layer, and which charges the layer with a predetermined potential.

In such an image formation unit, an electrostatic latent image of image information is formed on the photosensitive drum 101 by means of the exposure device. The electrostatic latent image is made visible in the form of a toner image by the developer roller 106 and transferred onto the intermediate transfer belt. In a four-color image formation apparatus, toner images of respective colors are transferred onto the intermediate transfer belt, to thereby finally produce a multiple color image.

However, as illustrated, the cleaning blade 103, the developer roller 106, and the toner feed roller 105 are arranged in this order with the photo sensitive drum 101 interposed between the blade 103 and the developer roller 106. Hence, the intermediate transfer belt in one image formation unit becomes longer in the direction in which the belt is to travel (i.e., a horizontal direction in the drawing). For this reason, an interval between the photosensitive drums 101 of the four-color image formation units tend to become greater.

As mentioned above, if the interval between the photosensitive drums 101 is excessive, a limitation is imposed on miniaturization of the apparatus. Further, an interval between transfer positions on the intermediate transfer belt also becomes wider. In the case of formation of a multiple color images, the transfer accuracy of color is deteriorated, thereby inducing color misregistration and resulting in a failure to form a superior color image. In addition, the transfer belt must be made longer, and hence a color image becomes apt to color misregistration in the same manner, thus presenting a problem of the apparatus becoming bulky and expensive.

SUMMARY OF THE INVENTION

The invention aims at providing a color image formation apparatus which can be miniaturized by rendering an arrangement pitch between photosensitive drums short and can maintain high accuracy in transfer of an image onto an intermediate transfer belt.

In one aspect of the invention, there is provided a color image formation apparatus including: a plurality of stages of photosensitive drums provided for respective developing agents; developer units which are provided for respective photosensitive drums and which develop electrostatic latent images formed on the photosensitive drums, wherein an overlap in an arrangement direction of the drums exists between a portion of each photosensitive drum and a portion of the developer unit provided to correspond to an adjacent photosensitive drum. By means of such a configuration, a dead space is eliminated, thereby scaling down the width of the apparatus.

DETAILED DESCRIPTION OF THE PREFERRED EMBODIMENT

Embodiments of the invention will be described hereinbelow by reference to the drawings.

(Embodiment 1)

Figure 1:
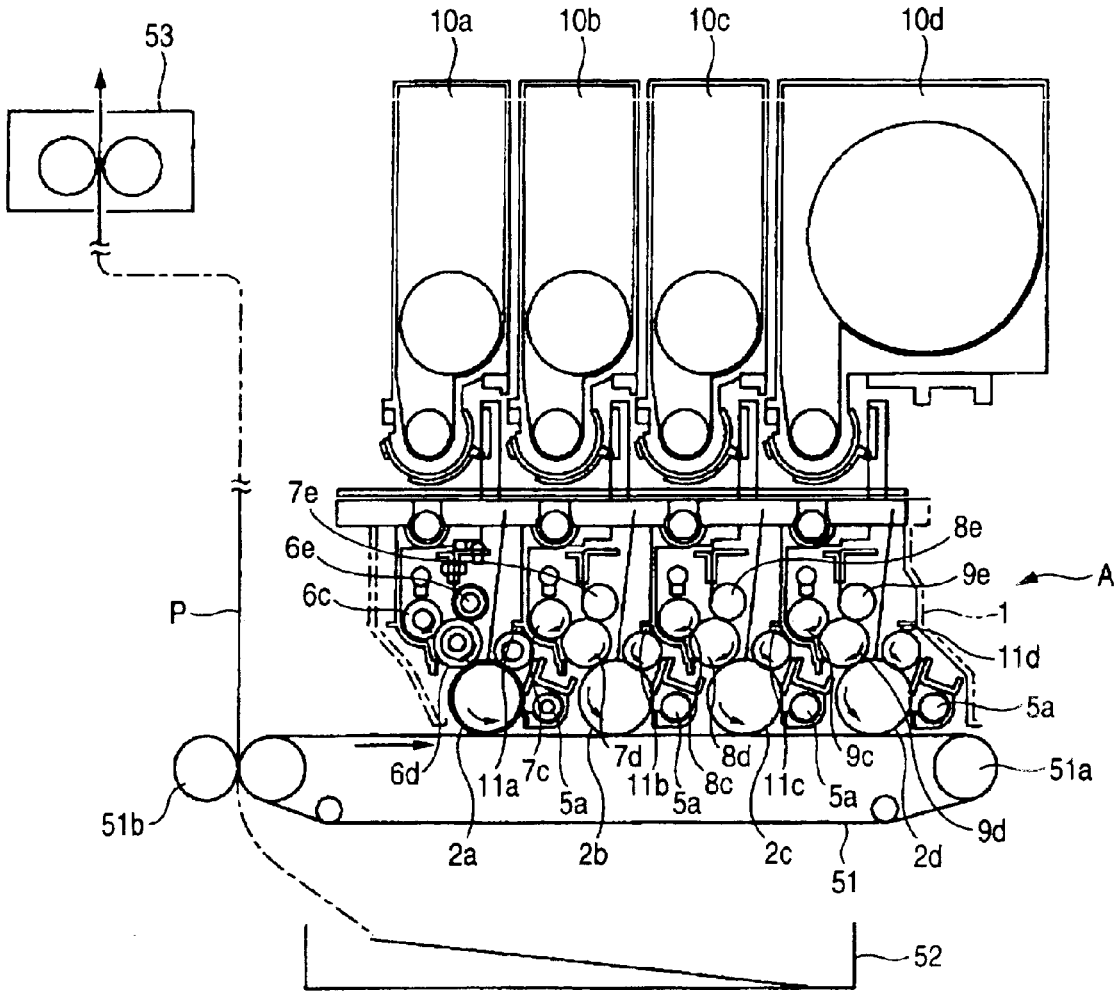
FIG. 1 is a schematic front view showing the configuration of a color image formation apparatus according to a first embodiment of the invention.

FIG. 1 is a schematic front view showing the configuration of a color image formation apparatus according to a first embodiment of the invention.

As shown in FIG. 1, the color image formation apparatus is substantially constructed such that an intermediate transfer belt 51 which is driven by drive pulleys 51*a* in the direction of the arrow is provided in the form of a closed loop and such that paper P is fed to a fuser 53 from a paper cassette 52 located at a position below the intermediate transfer belt 51 by way of a space between a transfer roller 51*b* and the intermediate transfer belt 51. In short, a color toner image formed on the intermediate transfer belt 51 is transferred onto the paper P to be nipped by the transfer roller 51*b*, and the transferred toner image is fixed on the paper P by means of the fuser 53. An exposure device (not shown) which radiates a laser beam in accordance with image information is disposed at a position above the intermediate transfer belt 51. Disposed between the exposure and the intermediate transfer belt 51 is an image formation unit A for sequentially producing a yellow (Y) image, a magenta (M) image, a cyan (C) image, and a black (K) image.

Figure 2:
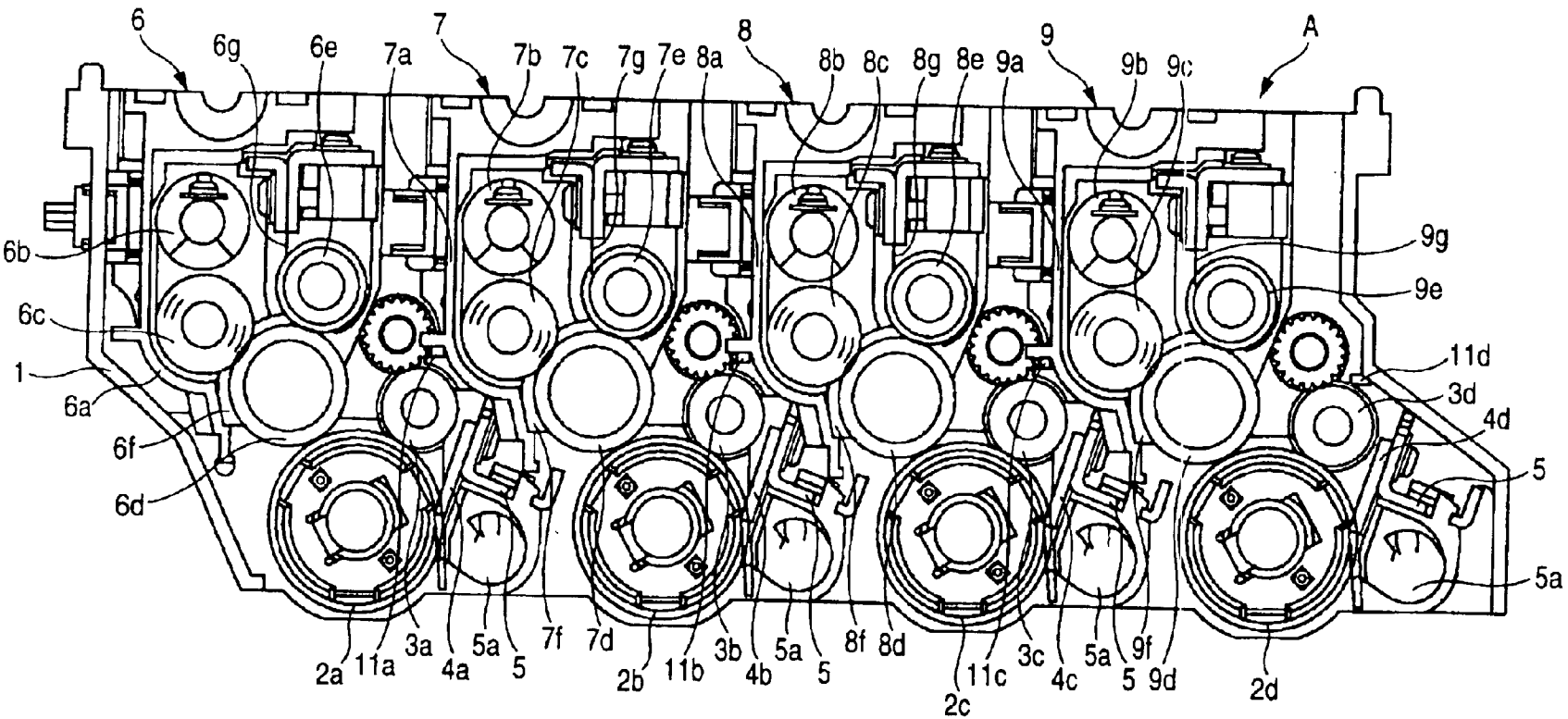
FIG. 2 is a longitudinal front cross-sectional view of the principal section obtained when a developer unit is fitted to a housing having a photosensitive drum and a charging bracket.
Figure 3:
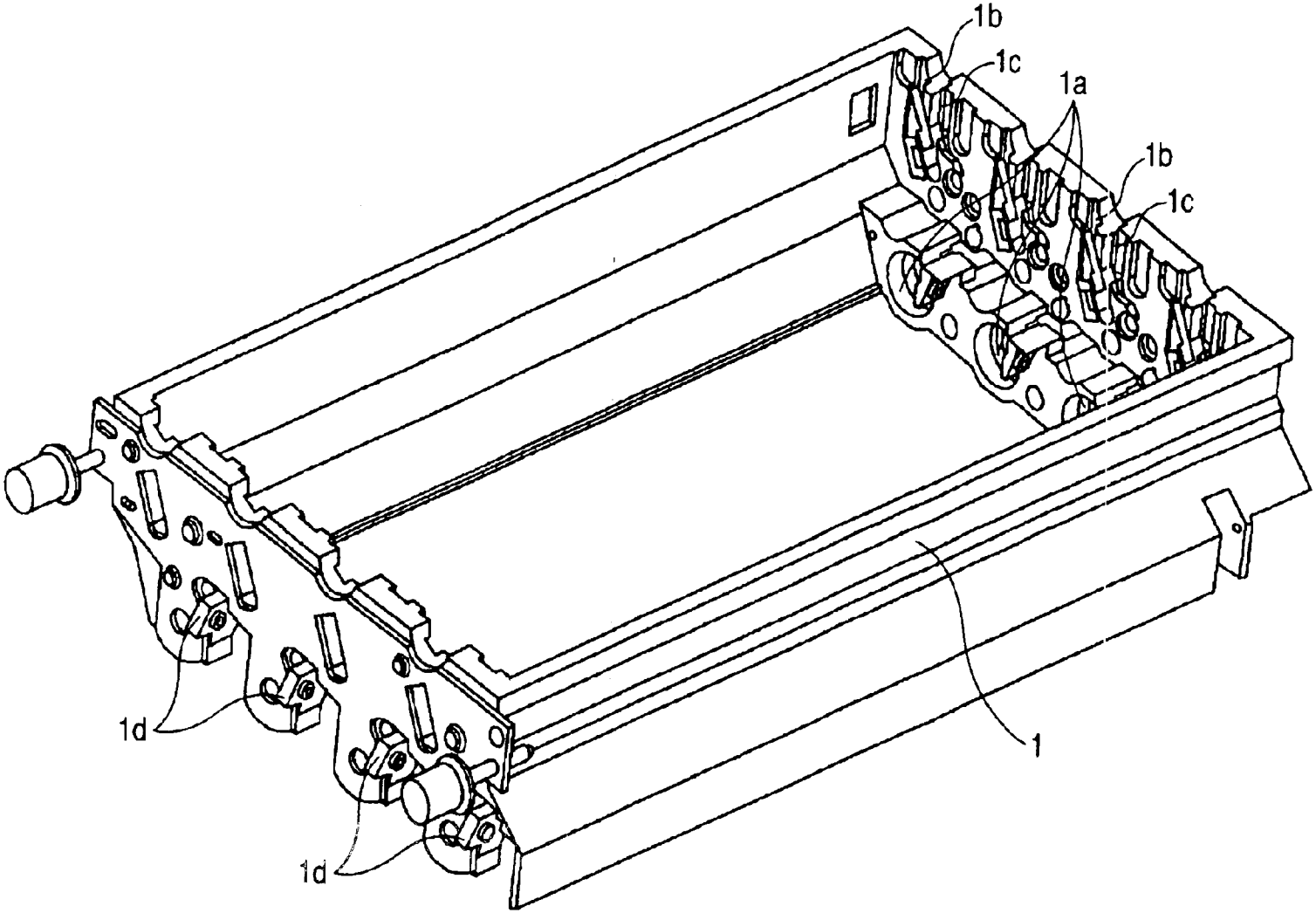
FIG. 3 is a perspective view of a housing.

FIG. 2 is a longitudinal front cross-sectional view of the principal section obtained when a developer unit is fitted to a housing having photosensitive drums and a charging bracket. FIG. 3 is a perspective view of the housing.

As shown in FIG. 3, the housing 1 is a box-shaped housing whose top and bottom are opened. Photosensitive drums 2*a*, 2*b*, 2*c*, and 2*d* shown in FIG. 2, which come into contact with the transfer belt 51 to transfer a toner image, are supported at a lower end of the housing such that the drums 2*a* to 2*d* can be rotated in a clockwise direction by an external drive mechanism. The photosensitive drums 2*a* to 2*d* are arranged so that an electrostatic latent images can be formed on respective circumferential surfaces of the drums by means of a laser beam output from the exposure device (not shown). The photosensitive drums 2*a* to 2*d* can be removed from removal holes 1*a* formed in one end wall of the housing 1 shown in FIG. 3. Further, charger brushes 3*a*, 3*b*, 3*c*, and 3*d* which come into contact with and charge the circumferential surfaces of the photosensitive drums 2*a* to 2*d* are rotatively provided in the vicinities of the photosensitive drums 2*a* to 2*d*. Cleaning blades 4*a*, 4*b*, 4*c*, and 4*d* are arranged to be used for exfoliating and removing the toner that remains after the toner image has been transferred onto the intermediate transfer belt 51. The photosensitive drums 2*a* to 2*d*, the charger brushes 3*a* to 3*d*, and the cleaning blades 4*a* to 4*d* constitute a photosensitive unit.

Figure 4:
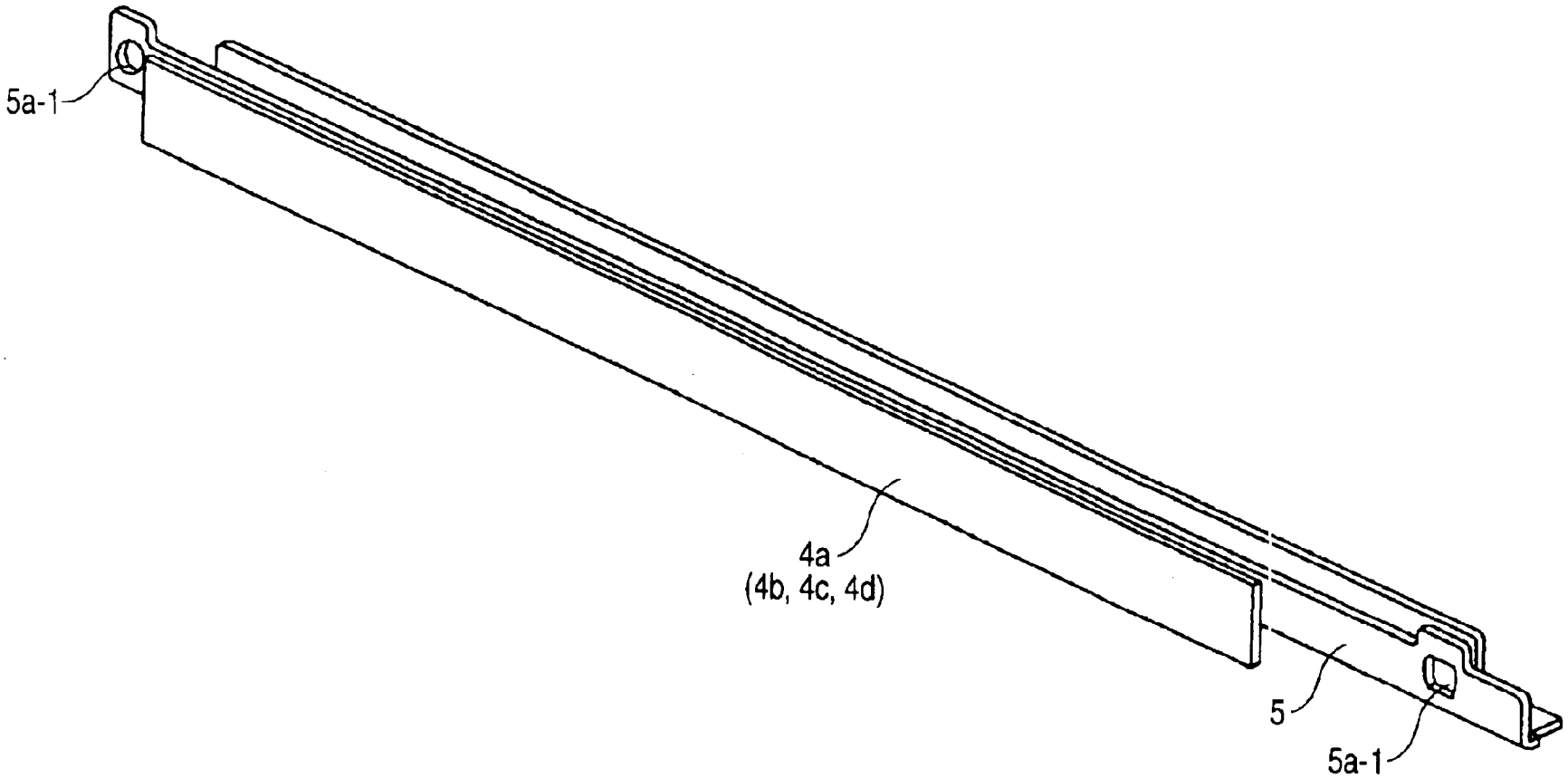
FIG. 4 is a perspective view of a cleaning blade retained by a support.

FIG. 4 is a perspective view of the cleaning blade 4*a* (4*b* 4*d*) retained by a support. As is evident from FIG. 2, the cleaning blade 4*a* (4*b* to 4*d*) which is formed as rubber as raw material is integrally provided on a metal plate support 5 having a substantially horseshoe shaped cross-sectional profile. As shown in FIG. 3, the supports 5 are caused to butt against corresponding holding seats 1*d* which are obliquely formed on exterior surfaces of both end walls of the housing 1. The supports 5 are fastened to the holding seats 1*d* by insertion of small screws into holes 5*a*-1 formed in the supports 5.

A pair of mount grooves 1*b*, 1*c* are formed at four locations on an interior surface of the end wall of the housing 1. A yellow (Y) developer unit 6, a magenta (M) developer unit 7, a cyan (C) developer unit 8, and a black (K) developer unit 9 are removably inserted into the housing 1 from above while being guided by the mount grooves 1*b*, 1*c*. As shown in FIG. 1, toner feed channels of the developer units 6 to 9 can be connected to toner tanks 10*a*, 10*b*, 10*c*, and 10*d* which house color toners and are removably attached to a main unit of the image formation apparatus.

The respective developer units 6 to 9 are provided with casings 6*a*, 7*a*, 8*a*, and 9*a* which are housed in the housing 1 so that toner flow channels of the casings can be connected to the toner tanks 10*a* to 10*d*. Agitators 6*b*, 7*b*, 8*b*, and 9*b* for agitating toner, toner feed rollers 6*c*, 7*c*, 8*c*, and 9*c*, developer rollers 6*d*, 7*d*, 8*d*, and 9*d*, and thin-layer rollers 6*e*, 7*e*, 8*e*, and 9*e* are rotatably housed in the casings 6*a*, 7*a*, 8*a*, and 9*a*, respectively. The toner feed rollers 6*c* to 9*c* cause toner to adhere to the developer rollers 6*d* to 9*d*; and the thin-layer rollers 6*e* to 9*e* make toner layers of the developer rollers 6*d* to 9*d* thinner and charge the developer rollers 6*d* to 9*d* with a predetermined potential. The developer rollers 6*d* to 9*d* are intended for forming toner images by causing toner to adhere to the electrostatic latent images formed on the photosensitive drums 2*a* to 2*d* by means of charging. Provided at lower ends of the casings 6*a* to 9*a* are recovery sheets 6*f*, 7*f*, 8*f*, and 9*f* which come into contact with the developer rollers 6*d* to 9*d*, to thereby cause the toner feed rollers 6*c* to 9*c* to recover adhering toner and prevent transfer of toner to the intermediate transfer belt 51. Further, scrapers 6*g*, 7*g*, 8*g*, and 9*g*, which come into contact with circumferential surfaces of the thin-layer rollers 6*e* to 9*e* to remove adhering toner, are provided in the vicinity of the thin-layer rollers 6*e* to 9*e*.

Figure 5:
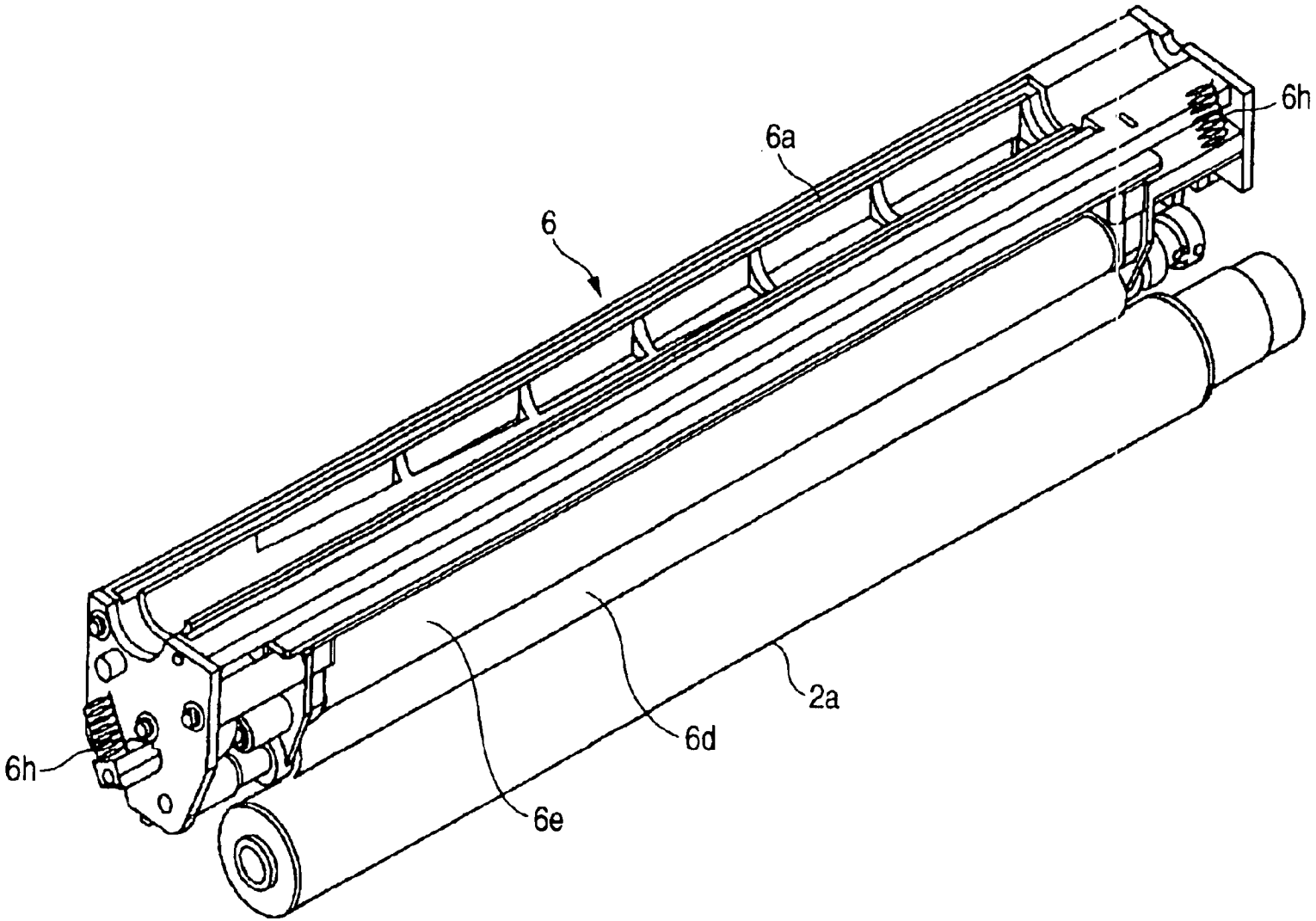
FIG. 5 is a perspective view showing one developer unit along with a photosensitive drum.
Figure 6:
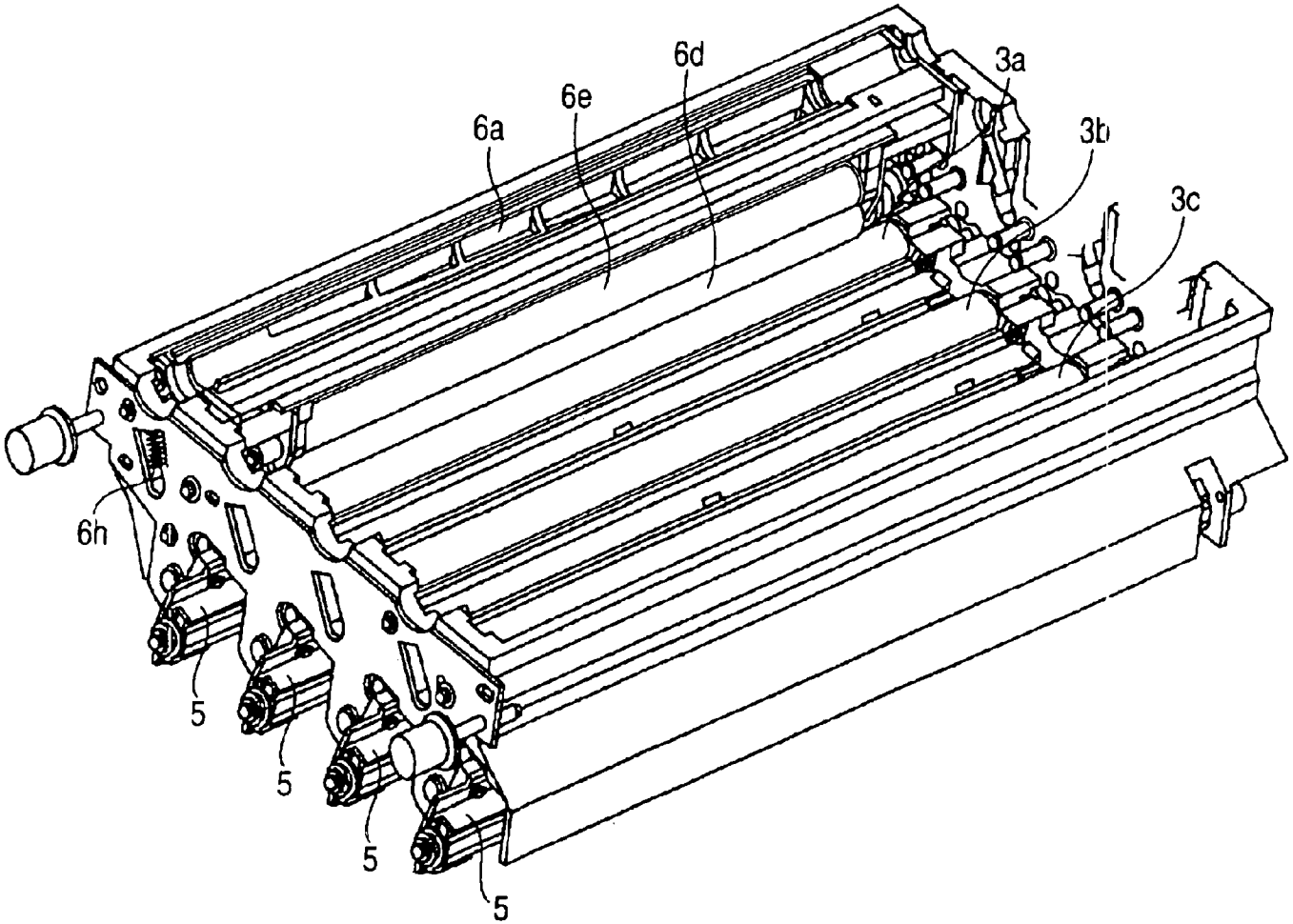
FIG. 6 is a perspective view showing a yellow developer unit when the unit is built into the housing.
Figure 7:
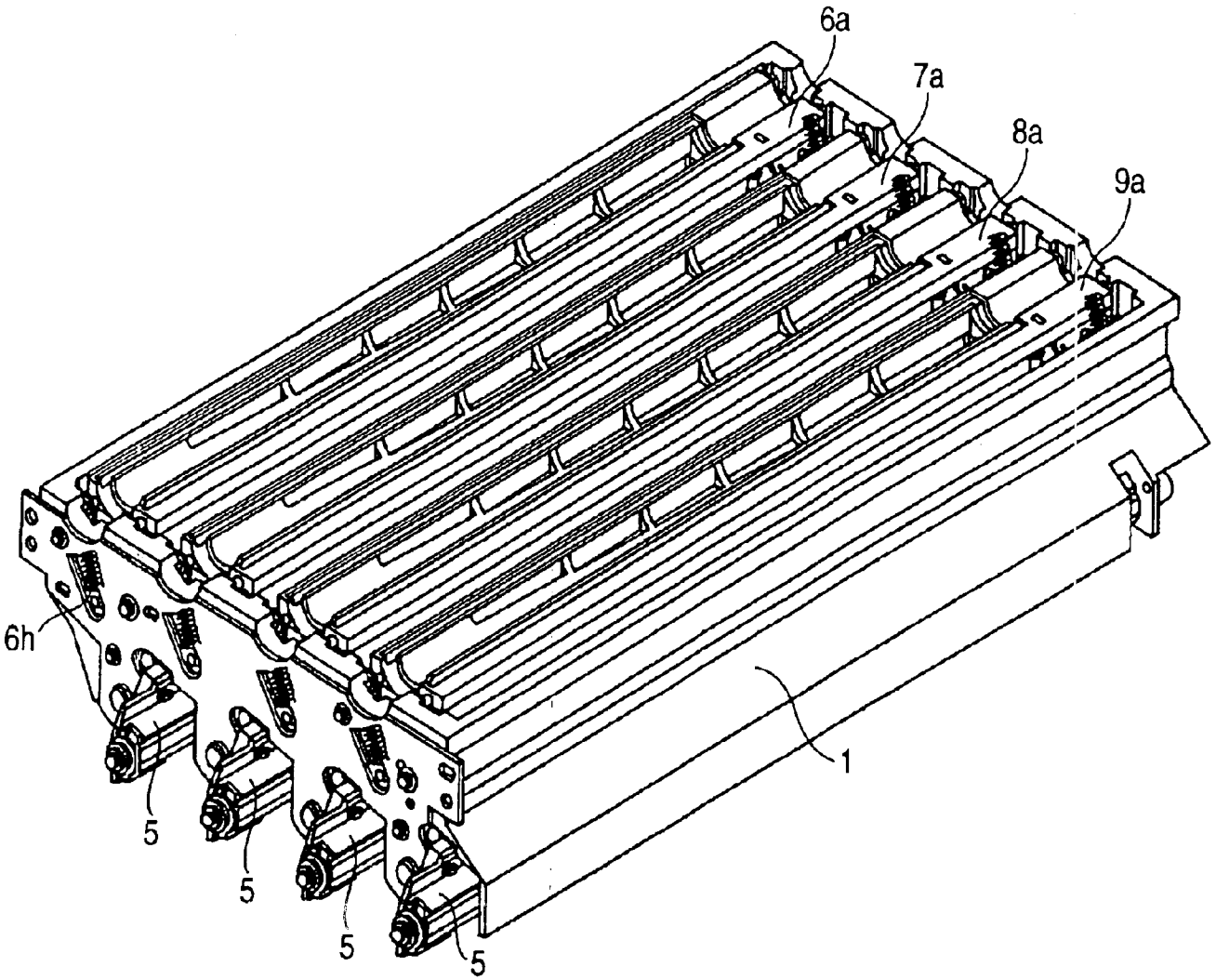
FIG. 7 is a perspective view showing all developer units when the units are built into the housing.

FIG. 5 is a perspective view showing one developer unit 6 along with the corresponding photosensitive drum 2*a*. FIG. 6 is a perspective view showing a yellow developer unit when the unit is built into the housing. FIG. 7 is a perspective view showing all developer units when the units are built into the housing. As illustrated, a spring 6*h* is provided on either end of the casing 6*a*. As shown in FIG. 6, when the casing 6*a* is inserted into the housing 1, the springs 6*h* engage with receiving seats (not shown) provided on the internal wall of the housing 1, thereby forcing the casing 6*a* in a downwardly oblique direction. As a result, the developer unit can be assembled such that the developer roller 6*d* remains in contact with the circumferential surface of the photosensitive drum 2*a* with appropriate pressing force. The same also applies to assembly of the casings 7*a* to 9*a* of the other developer units 7 to 9. FIG. 7 shows that all developer units 6 to 9 are set in the housing 1.

Turning back to FIGS. 1 and 2, discharge units 5*a*, each having a built-in screw to be used for recovering toner, are provided at locations below the respective supports 5 of the cleaning blades 4*a* to 4*d*. The discharge units 5*a* have the function of recovering the toner scraped by the cleaning blades 4*a* to 4*d* and discharging the thus-recovered toner.

Since the toner still remaining on the circumferential surfaces of the photosensitive drums 2*a* to 2*d* adheres to the charger brushes 3*a* to 3*d*, pads 11*a*, 11*b*, 11*c*, and 11*d* are provided for removing the residual toner. The pads 11*a*, 11*b*, and 11*c*, are provided on exterior walls of the casings 7*a*, 8*a*, and 9*a* provided on the right side. The remaining pad 11*d* is provided on the interior wall of the housing 1. The casings 7*a*, 8*a*, and 9*a* are formed so as to assume such a cross-sectional profile that the casings pass by the vicinities of the charger brushes 3*a*, 3*b*, and 3*c* of the developer units 6, 7, and 8 provided on the left side. Portions of the circumferential surfaces of the charger brushes 3*a* to 3*c* can be covered by means of the shapes of the casings 7*a* to 9*a*. Accordingly, the casings 7*a* to 9*a* can block splashing of toner which would be caused at the time of rotation of the charger brushes 3*a* to 3*c*. In this way, the casings 7*a* to 9*a* act as covers for the charger brushes 3*a* to 3*c* of the units located on the left side of the casings. Simultaneously, the casings 7*a* to 9*a* can also be utilized as members for mounting the pads 11*a* to 11*c* for removing adhering toner. Consequently, there is obviated a necessity for members specifically designed for use as covers of the charger brushes 3*a* to 3*c* or for mounting the pads 11*a* to 11*c*, thereby enabling narrowing of surrounding space occupied by charger brushes 3*a* to 3*c*.

Here, the cleaning blades 4*a* to 4*c* are located between the adjacent photosensitive drums 2*a* to 2*c*, and the supports 5, each having a substantially horseshoe shaped cross-sectional profile, support the rear surfaces of the cleaning blades 4*a* to 4*c*. As a result, the supports 5 are slightly, downwardly tilted toward the right while surfaces of the supports 5 facing the developer rollers 7*d*, 8*d*, and 9*d* are recessed. Therefore, the toner that still adheres to the developer rollers 7*d*, 8*d*, and 9*d* and could not be recovered by the recovery sheets 7*f*, 8*f*, and 9*f* can be received by the supports 5. Only the supports 5 and the cleaning blades 4*a* to 4*c* held thereby are interposed between the four photosensitive drums 2*a* to 2*d*. As a result, the intervals between the photosensitive drums 2*a* to 2*d* can be made narrow. Further, as mentioned previously, the supports 5 can also be utilized as members for receiving toner. Hence, the developer rollers 7*d* to 9*d* which most easily release toner are preferably located at positions above the supports 5, and the supports 5 are preferably located at positions below the recovery sheets 7*f* to 9*f* on which toner falls from the circumferential surfaces of the toner feed rollers 7*c* to 9*c*. According to the invention, shaft cores of the developer rollers 7*d* to 9*d* of the developer units 7 to 9 are aligned with lines located at higher left positions relative to the centers of the photosensitive drums 2*b* to 2*d*. Such an arrangement is also applicable to the developer roller 6*d* of the developer unit 6. Falling toner can be received and recovered by a lower end of the housing 1.

By virtue of the positional relationship between the photosensitive drums 2*a* to 2*d* and the developer rollers 6*d* to 9*d*, the photosensitive drums 2*a* to 2*d* are not susceptible to interference which is induced in a direction of arrangement by the developer rollers 7*d* to 9*d*. Consequently, the intervals between the photosensitive drums 2*a* to 2*d* can be made shorter than those required by the construction described in connection with the related-art color image formation apparatus. The developer rollers 6*d* to 9*d* are not positioned at locations immediately above the photosensitive drums 2*a* to 2*d*, but at positions located leftwardly oblique with respect to the photosensitive drums 2*a* to 2*d*. Hence, the heights of the developer rollers 6*d* to 9*d* and those of the photosensitive drums 2*a* to 2*d* can also be reduced. As mentioned previously, the developer rollers 7*d* to 9*d* are located at positions above the supports 5. Hence, the toner discharged from the developer rollers 7*d* to 9*d* can be received by the supports 5, thereby preventing adhesion of useless toner to the intermediate transfer belt 51.

A process of transferring toner images from the photosensitive drums 2*a* to 2*d* to the intermediate transfer belt 51 and operation for transferring the toner image from the intermediate transfer belt 51 to the paper. P by means of the transfer rollers 51*b* are the same as those in the related-art tandem image formation apparatus.

(Embodiment 2)

A second embodiment of the invention will now be described.

Figure 8:
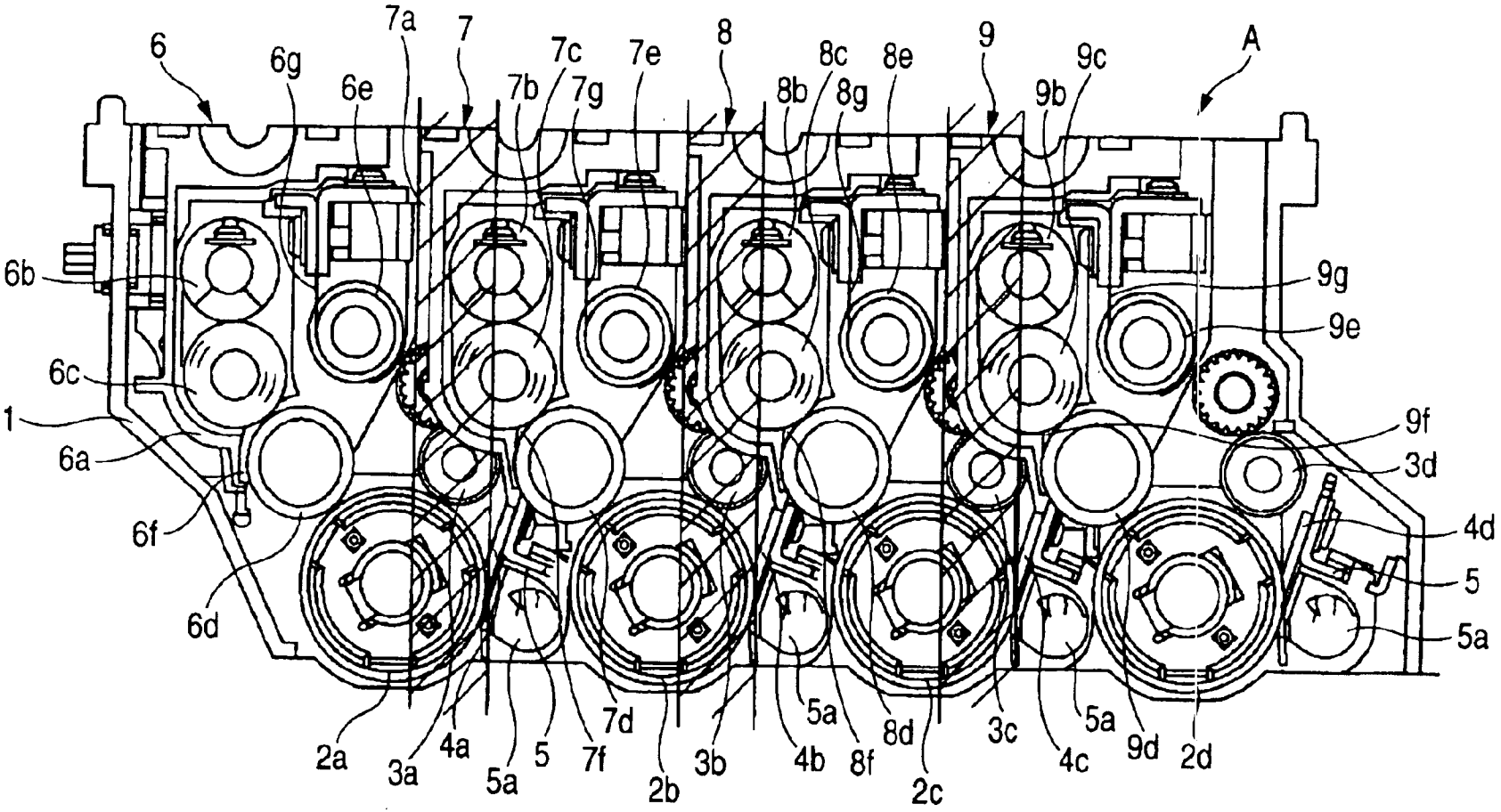
FIG. 8 is a longitudinal front cross-sectional view of a color image formation apparatus according to the second embodiment of the invention.
Figure 9:
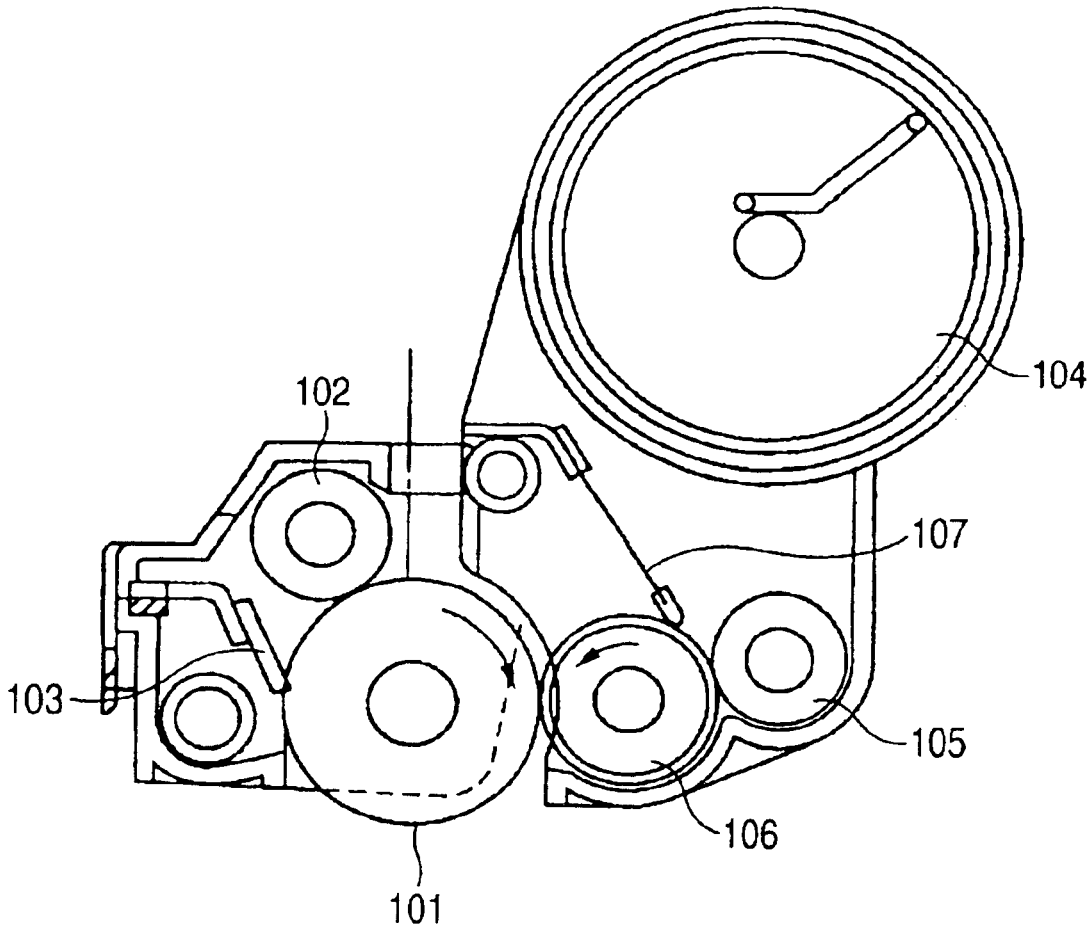
PRIOR ART FIG. 9
FIG. 9 is a schematic front view of the principal section showing an example configuration of a related-art developer unit and that of a photosensitive unit.

FIG. 8 is a longitudinal front cross-sectional view of a color image formation apparatus according to the second embodiment of the invention. Those constituent elements which are the same as those described by reference to FIGS. 2 through 7 are assigned the same reference numerals, and their repeated explanations are omitted.

As shown in FIG. 8, the cleaning blades 4*a* to 4*c* are located between the adjacent photosensitive drums 2*a* to 2*c*, and the supports 5, each having a substantially horseshoe shaped cross-sectional profile, support the rear surfaces of the cleaning blades 4*a* to 4*c*. As a result, the supports 5 are slightly, downwardly tilted toward the right while surfaces of the supports 5 facing the developer rollers 7*d*, 8*d*, and 9*d* are recessed. Therefore, the supports 5 can receive the toner that still adhere to the developer rollers 7*d*, 8*d*, and 9*d* and cannot have been recovered by the recovery sheets 7*f*, 8*f*, and 9*f*. Only the supports 5 and the cleaning blades 4*a* to 4*c* held thereby are interposed between the four photosensitive drums 2*a* to 2*d*. As a result, the intervals between the photosensitive drums 2*a* to 2*d* can be made narrow. Further, as mentioned previously, the supports 5 can also be utilized as members for receiving toner. Hence, the developer rollers 7*d* to 9*d* which most easily release toner are preferably located at positions above the supports 5, and the supports 5 are preferably located at positions below the recovery sheets 7*f* to 9*f* on which toner falls from the circumferential surfaces of the toner feed rollers 7*c* to 9*c*. According to the invention, shaft cores of the developer rollers 7*d* to 9*d* of the developer units 7 to 9 are aligned with lines located at higher left positions relative to the centers of the photosensitive drums 2*b* to 2*d*. Such an arrangement is also applicable to the developer roller 6*d* of the developer unit 6. Falling toner can be received and recovered by a lower end of the housing 1.

The developer units 6, 7, 8, and 9 are arranged close to each other. As indicated by a hatched area shown in FIG. 8, a portion of the photosensitive drum 2*a* and that of the developer unit 7 are positioned such that an overlap exists between the same in a direction parallel to that in which the photosensitive drums 2*a*, 2*b*, 2*c*, and 2*d* are arranged. Similarly, as indicated by the hatched area shown in FIG. 8, a portion of the photosensitive drum 2*b* and that of the developer unit 8, and a portion of the photosensitive drum 2*c* and that of the developer unit 9 are respectively positioned such that an overlap exists between the same in a direction parallel to that in which the photosensitive drums 2*a*, 2*b*, 2*c*, and 2*d* are arranged.

Put it another way; as indicated by the hatched area shown in FIG. 8, a portion of the developer unit 7 is superimposed above a portion of the photosensitive drum 2*a*. Similarly, as indicated by the hatched area shown in FIG. 8, a portion of the developer unit 8 is superimposed above a portion of the photosensitive drum 2*b*, and a portion of the developer unit 9 is superimposed above a portion of the photosensitive drum 2*c*.

Preferably, at least a portion of the developer units 7, 8, 9 and at least one-third of the photosensitive drums 2*a*, 2*b*, 2*c* are respectively positioned such that an overlap exists between the developer units 7, 8, 9 and the photosensitive drums 2*a*, 2*b*, 2*c* in a direction parallel to that in which the photosensitive drums 2*a*, 2*b*, 2*c*, and 2*d* are arranged Such a configuration enables elimination of dead space, thereby reducing the width of the color image formation apparatus.

The photosensitive drum 2*a*, the developer roller 6*d*, and the toner feed roller 6*c* are arranged such that their shaft cores are arranged in substantially a straight line. Preferably, the developer roller 6*d* is arranged so as to oppose the photosensitive drum 2*a* at an angle of about 45° from a direction in which the photosensitive drums 2*a* to 2*d* to the toner feed roller 6*c*. Needless to say, the same relationship can also be applied to the four stages.

In another configuration, the photosensitive drum 2*a* and the developer roller 6*d* are arranged such that their shaft cores are arranged in substantially a straight line. The shaft core of the toner feed roller 6*c* may be provided at a position closer to the thin-layer roller 6*e* with reference to a line connecting the shaft core of the photosensitive drum 2*a* to that of the developer roller 6*d*. Needless to say, the same relationship can also be applied to the four stages.

Alternatively, put it in another way; the toner feed roller 6*c* can be provided at a position where an angle defined between the normal (or a direction perpendicular to a direction in which the photosensitive transfer member drums 2*a* to 2*d*) and a line connecting together the shaft core of the photosensitive drum 2*a* and that of the developer roller 6*d* becomes greater than that defined between the normal (or a direction perpendicular to a direction in which the photosensitive transfer member drums 2*a* to 2*d*) and a line connecting together the shaft core of the photosensitive drum 2*a* and that of the toner feed roller 6*c*. Needless to say, this relationship can also be applied to the four stages.

By means of such a configuration, the volume and width of each of the developer units 6, 7, 8, and 9 can be reduced. Further, a total volume and dimension of the photosensitive drums 2*a* to 2*d* and the developer units 6 to 9 can also be reduced.

According to the invention, only cleaning blades held by supports are interposed between photosensitive drums. Developer rollers are aligned with lines which are located at positions higher than the supports and leftwardly tilted relative to the axes of the respective photosensitive drums. Hence, an interval between the photosensitive drums can be made narrower than that required by the photosensitive drums having the related-art structure. Consequently, miniaturization of the image formation apparatus and a reduction in intervals between transfer positions on an intermediate transfer belt can be achieved simultaneously, thereby enabling formation of a superior color image. Moreover, the intermediate transfer belt is also shortened, and hence a time required for a transfer process is also shortened, thus significantly enhancing operability of the image formation apparatus.

The volume and width of the developer units can also be reduced. In addition, the total volume and dimension of the photosensitive drums and the developer units can also be reduced.

What is claimed is:

1. An image formation apparatus comprising:

first and second photosensitive drums arranged in a predetermined direction;

first and second developer rollers which are respectively provided to correspond to the first and second photosensitive drums and which cause toner to adhere to electrostatic latent images formed on the first and second photosensitive drums by means of charging for forming toner images on the respective first and second photosensitive drums; and first and second toner feed rollers which are respectively provided to correspond to the first and second developer rollers and feed toner to the first and second developer rollers, wherein the first toner feed roller and the second photosensitive drum are arranged such that an overlap exists between the first toner feed roller and the second photosensitive drum in the predetermined direction.

2. The image formation apparatus according to claim 1, wherein the first developer roller is arranged so as to oppose the first photosensitive drum at an angle of about 45° from the predetermined direction to the first toner feed roller.

3. The image formation apparatus according to claim 1, further comprising:

a first developer unit housing the first developer roller and the first toner feed roller, wherein an overlap exists in the predetermined direction between at least a portion of the first developer unit and at least one-third of the second photosensitive drum.

4. The image formation apparatus according to claim 3, further comprising a second developer unit housing the second developer roller and the second toner feed roller; and a third photosensitive drum arranged in the predetermined direction with respect to the first and second photosensitive drums, wherein an overlap exists in the predetermined direction between at least a portion of the second developer unit and at least one-third of the third photosensitive drum.

5. The image formation apparatus according to claim 4, wherein the first developer unit houses a first agitator which is provided so as to correspond to the first toner feed roller and agitates toner, and the second developer unit houses a second agitator which is provided so as to correspond to the second toner feed roller and agitates toner.

6. The image formation apparatus according to claim 3, wherein the first developer unit houses a first agitator which is provided so as to correspond to the first toner feed roller and agitates toner.

7. The image formation apparatus according to claim 1, further comprising:

a third photosensitive drum arranged in the predetermined direction with respect to the first and second photosensitive drums, wherein the second toner feed roller and the third photosensitive drum are arranged such that an overlap exists between the second toner feed roller and the third photosensitive drum in the predetermined direction.

8. The image formation apparatus further comprising:

first and second photosensitive drums arranged in a predetermined direction;

first and second developer rollers which are respectively provided to correspond to the first and second photosensitive drums and which cause toner to adhere to electrostatic latent images formed on the first and second photosensitive drums by of charging for forming toner images on the respective first and second photosensitive drums; and first and second toner feed rollers which are respectively provided to correspond to the first and second developer rollers and feed toner to the first and second developer rollers, wherein the first toner feed roller and the second photosensitive drum are arranged such that an overlap exists between the first toner feed roller and the second photosensitive drum in the predetermined direction; and first and second agitators which are provided to correspond to the first and second toner feed rollers and which stir toner, wherein the first agitator and the second photosensitive drum are arranged such that an overlap exists between the first agitator and the second photosensitive drum in the predetermined direction.

9. The image formation apparatus according to claim 8, wherein the first developer roller is arranged so as to oppose the first photosensitive drum at an angle of about 45° from the predetermined direction to the first toner feed roller.

10. The image formation apparatus according to claim 8, further comprising:

a third photosensitive drum provided in the predetermined direction with respect to the first and second photosensitive drums, wherein the second agitator and the third photosensitive drum are arranged such that an overlap exists between the second agitator and the third photosensitive drum in the predetermined direction.

* * * * *

UNITED STATES PATENT AND TRADEMARK OFFICE

CERTIFICATE OF CORRECTION

PATENT NO. : 6,842,597 B2
DATED : January 11, 2005
INVENTOR(S) : Yamaguchi et al.

It is certified that error appears in the above-identified patent and that said Letters Patent is hereby corrected as shown below:

Title page,
Item [73], Assignee, please delete "Matsushita Electric Industrial Company, Inc., Osaka (JP)" and insert therefor -- Matsushita Electric Industrial Co., Ltd., Osaka (JP) --.

Signed and Sealed this

Fifth Day of July, 2005

JON W. DUDAS
*Director of the United States Patent and Trademark Office*